US005769280A

United States Patent [19]

Ehresmann

[11] Patent Number: 5,769,280

[45] Date of Patent: Jun. 23, 1998

[54] INVERTED BOTTLE HOLDER AND STAND

[76] Inventor: Ervin Ehresmann, 33 Hibicus Ct., Doylestown, Pa. 18901

[21] Appl. No.: 926,936

[22] Filed: Sep. 10, 1997

Related U.S. Application Data

[63] Continuation-in-part of Ser. No. 783,862, Jan. 16, 1997, abandoned.

[51] Int. Cl.[6] ..... B67D 5/06

[52] U.S. Cl. ..... 222/185.1; 222/108

[58] Field of Search ..... 222/108, 173, 222/181.2, 181.3, 185.1; 141/364, 106, 375; 248/146, 149, 311.3, 312, 313; 211/74

[56] References Cited

U.S. PATENT DOCUMENTS

| | | | |
|---|---|---|---|
| 3,168,272 | 2/1965 | Swinyar | 248/313 X |
| 3,387,810 | 6/1968 | Sakier | 248/313 X |
| 3,402,844 | 9/1968 | Chin . | |
| 4,271,878 | 6/1981 | Bologa | 141/364 X |
| 5,105,860 | 4/1992 | Connor | 141/364 X |
| 5,292,035 | 3/1994 | Millar . | |
| 5,297,600 | 3/1994 | Downes et al. | 141/364 |
| 5,445,350 | 8/1995 | Rigsby | 248/313 |
| 5,460,298 | 10/1995 | DiBiase et al. . | |

*Primary Examiner*—Gregory L. Huson
*Attorney, Agent, or Firm*—Gregory J. Gore

[57] ABSTRACT

A bottle holder in the form of a flat planar support includes resiliently biased opposing jaws that capture the bottle cap in order to hold it in an inverted position. The jaws are resiliently biased with sufficient force to securely grip the cap. The stand is dimensioned such that when held in the inverted position, the bottle does not tip. Each jaw includes a V-shaped notch to provide dual-point clamping pressure on bottle caps of varying diameter. The jaws are biased toward a closed position by a resilient band which is fitted within a groove around the periphery of the holder. A stand for a plurality of holders includes a vertically-extended tower which is slightly larger than the aperture between the jaws in their closed position so that when stored on the stand about the tower, the holders grip the tower securely.

9 Claims, 4 Drawing Sheets

11
12
13
17
14
15
9

13
17
15
37
35
33

INVERTED BOTTLE HOLDER AND STAND

This application is a continuation-in-part of application Ser. No. 08/783,862, filed on Jan. 16, 1997 now abandoned.

FIELD OF THE INVENTION

The present invention relates to a holder for container inversion to promote full dispensing of viscous material from the container. More specifically, it relates to container inversion stands which grip the container closure cap.

BACKGROUND OF THE INVENTION AND DESCRIPTION OF THE PRIOR ART

Holders for container inversion used to facilitate the flow of viscous material from the container are well-known. Because of the viscosity of the material in the container, it is very difficult to efficiently remove the final amount of material which typically resides at the bottom of the container. The time it takes for the viscous material to move from the bottom to the top of the container where it is dispensed is often tedious and time-consuming. Therefore, there have been proposed many designs for container inversion holders which hold the container inverted so that the viscous material flows to the dispensing area of the container while the container is in storage. Thus, dispensing of even small amounts of material left in the bottle may be made quickly after the container is taken directly from storage.

Proposals for providing a device to hold a bottle-type container in inverted position include, for example, U.S. Pat. No. 5,460,298, issued to DiBiase et al. The holder disclosed in this reference is cup-shaped and interposed between the body of the bottle and its cap. The stand is affixed to the bottle by being captured between the base of a threadably-engaged cap and a shoulder around the neck of the bottle. This device is therefore limited to containers with shoulders and necks. U.S. Pat. No. 3,402,844 issued to Chin on Sep. 24, 1968 discloses an inverted bottle stand which includes an annular recess that engages the bottle cap by engagement of force-fit.

Neither of the above-cited references, however, show adaptability to containers having caps of varying diameter. To provide some adaptability in this regard, U.S. Pat. No. 5,292,035 to Millar discloses an inverting dispenser cap which includes a compressible seal located between the threaded bottle neck and a compression sleeve which clamps around the outside of the seal. While this device permits a small amount of adaptability to containers having varying diameter necks, it is not convenient because it is useable only as a cap replacement and the range of diameter to which it is adaptable is extremely slight, being mainly useful for affixation to container tops as a cap replacement where adaptability to different thread sizes is required.

Therefore, there is a need in the art for a convenient and easily used inverting bottle stand which is readily adapted to bottles having a wide range of cap diameters.

SUMMARY OF THE INVENTION

In order to meet the need in the art described above, the present device has been invented. The holder of the present invention is configured as a flat planar support which includes resiliently-biased opposing jaws that capture the bottle cap. The jaws are resiliently biased with sufficient force to securely grip the cap between the jaws. The stand is dimensioned such that when held in the inverted position, the bottle does not easily tip.

The bottle cap is firmly grabbed by two resiliently-biased sliding jaws. One jaw is stationary and rigidly affixed to side rails. A second opposing jaw is movable and slidably fitted between the rails and guided between positions closer to or farther away from the opposing stationary jaw. Each jaw includes a V-shaped notch to provide each jaw with dual-point clamping pressure on bottle caps of varying diameter. The jaws are biased toward the closed position by a resilient band which is fitted within a groove around the periphery of the holder.

It is therefore the primary object of the present invention to provide an inverted bottle holder which is convenient and easy to use and which will accommodate a variety of bottle caps of varying diameter. It is a further object of the present invention to provide a bottle holder which has a minimum number of parts that are easily manufactured. It is another object of the present invention to provide a grip-capping bottle holder in which the force-applying resilient means are inexpensively manufactured and easily replaced. It is yet a further object of the present invention to provide a stand for a plurality of bottle holders which will maintain them in compact securement for convenient storage.

Other objects, advantages and novel features of the invention will become apparent from the following detailed description of the invention when considered in conjunction with the accompanying drawings.

BRIEF DESCRIPTIONS OF THE DRAWINGS

Figure 6:
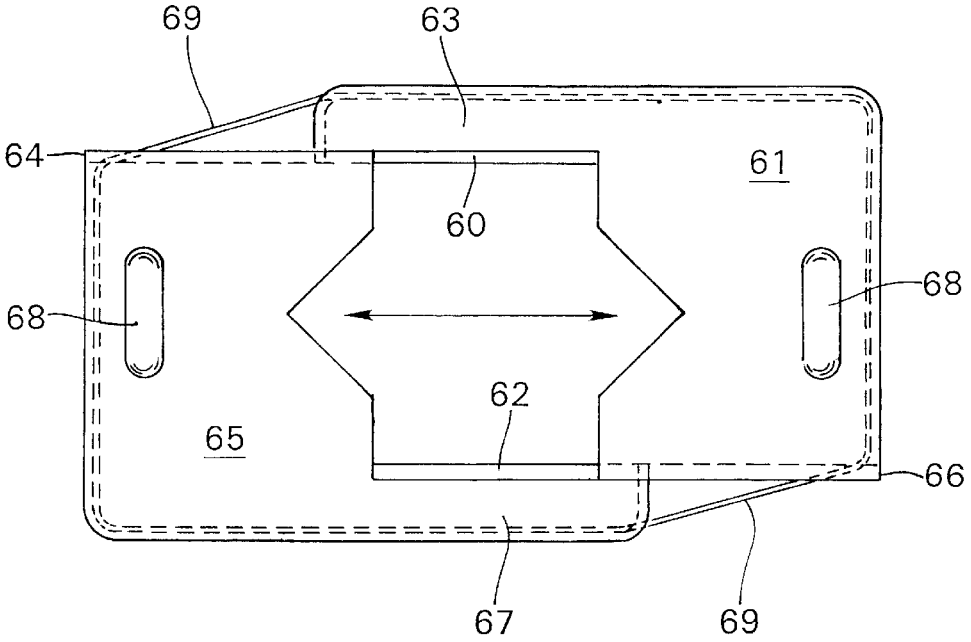
FIG. 6 is a top plan view showing an alternate embodiment of the present invention with the jaws in their retracted position.
Figure 6A:
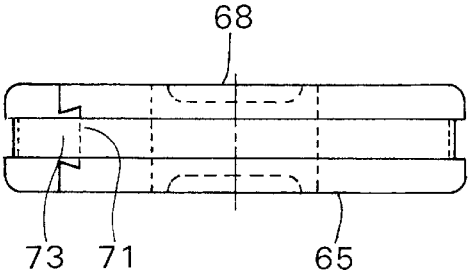
Figure 6B:
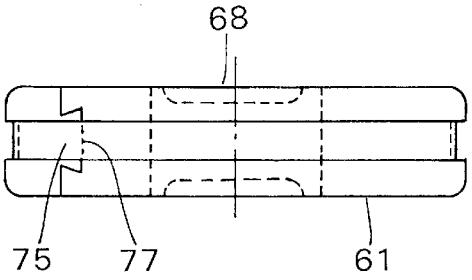

FIGS. 6*a* and 6*b* are left and right side elevational views respectively of the alternate embodiment of the present invention shown in FIG. 6.

DESCRIPTION OF THE PREFERRED EMBODIMENT

Figure 1:
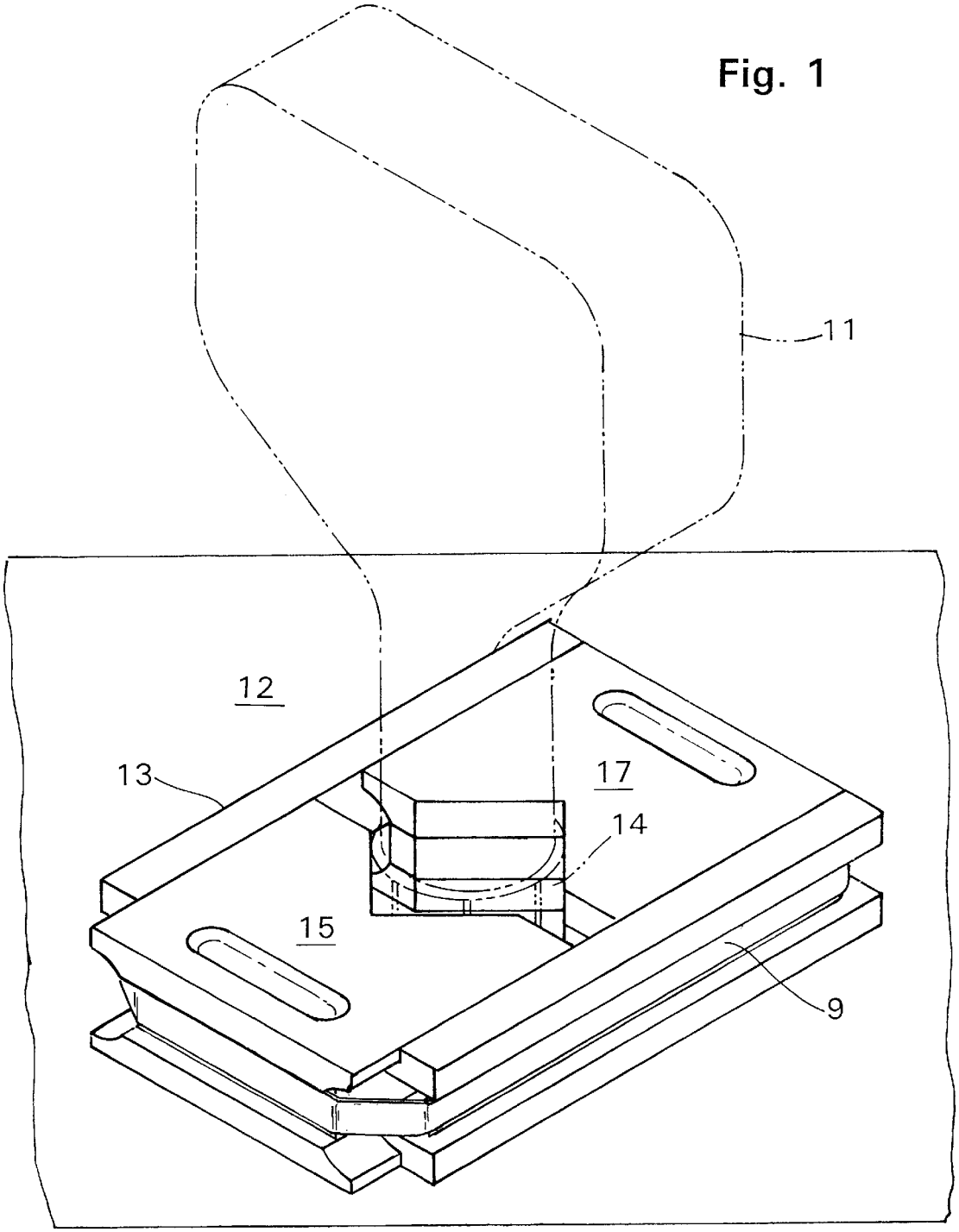
FIG. 1 is a front right top isometric view of the present invention.

Referring now to FIG. 1, the holder of the present invention 13 is shown firmly grasping the cap 14 of inverted bottle 11. The holder 13 is substantially planar with a flat bottom that sits squarely on supporting surface 12. The holder includes a stationary jaw 17 and a movable jaw 15 which are urged together by an elastic band 9.

Figure 2:
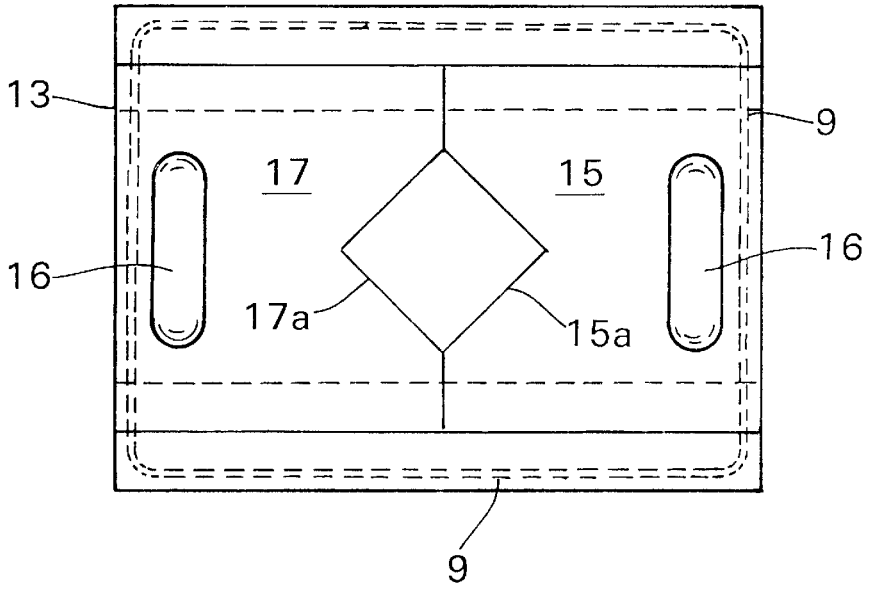
FIG. 2 is a top plan view.

Referring now to FIG. 2, the holder 13 is shown with the jaws 17 and 15 in their closed position. Finger grips 16 are depressions in the jaws to permit convenient manual grasping of the jaws. As clearly depicted in this figure, the elastic band 9 in the form of an endless loop travels around the periphery of the holder and secures the jaws in a closed position. As further shown in this figure, each jaw contains a centrally-located V-shaped notch 15*a* and 17*a* respectively. The notches are aligned so that they are directly opposing. As illustrated in this figure, each notch has an included angle of approximately 90-degrees, however, it should be understood that this angle may vary as a matter of design choice.

Figure 3:
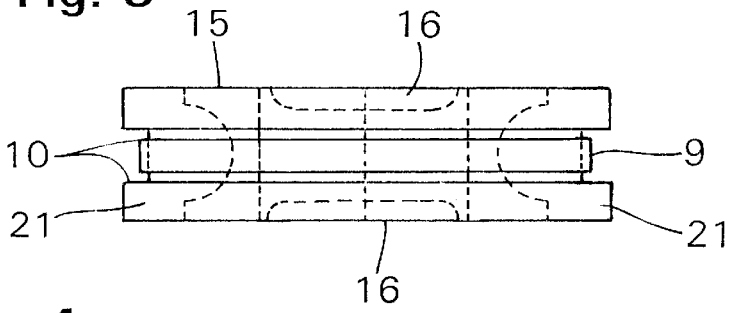
FIG. 3 is a right side view.

Referring now to FIG. 3, finger grips 16 and resilient band 9 are more clearly shown.

The band is retained vertically in the holder by the shoulders of a peripheral groove 10 which encircles the sides of the holder. From this view, the mating relationship of the semi-circular side rails 21 with the body of the movable jaw 15 is also shown.

Figure 4:
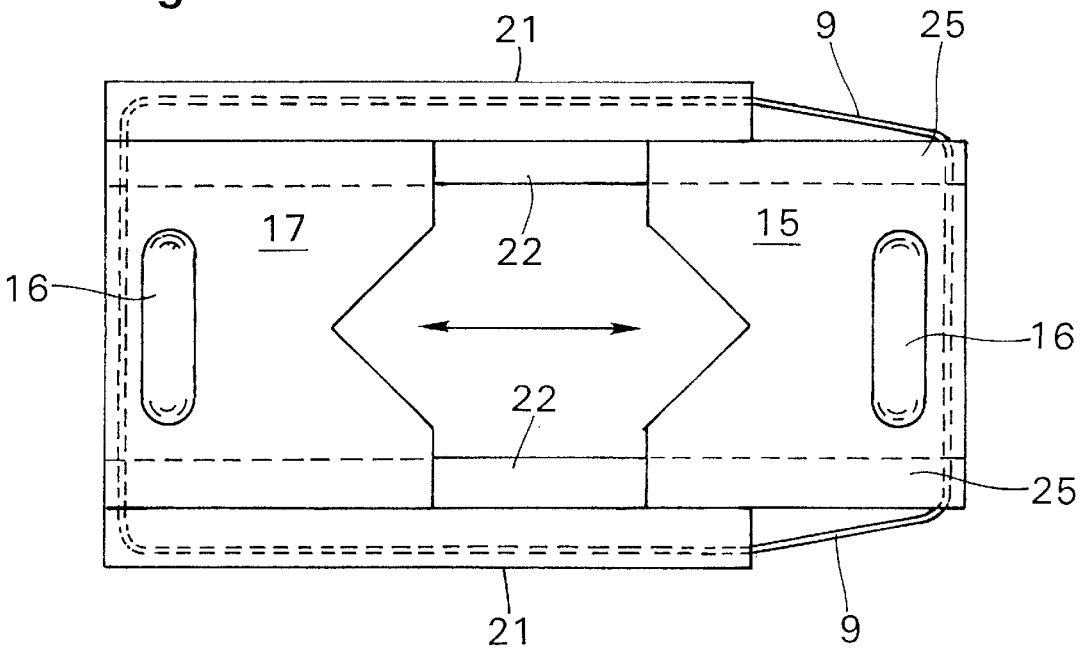
FIG. 4 is a top plan view showing the present invention with the slidable jaw in its retracted position.

Referring now to FIG. 4, the view of FIG. 2 is shown with the holder alternatively in its retracted position. Side rails 21 include inner-facing tongue portions 22 which as more clearly depicted in the previous FIG. 3 are semi-circular. Mating grooves 25 in the movable jaw 15 provide an interlocking slidable engagement with the rails such that the sliding jaw 15 is held in planar alignment with the fixed jaw 17 throughout the range of its motion toward. It will be readily understood from this figure that the V-grooves of the opposing jaws are resiliently biased toward each other by elastic band 9 and make possible the accommodation of firmly grasping bottle caps of varying diameter.

Figure 5:
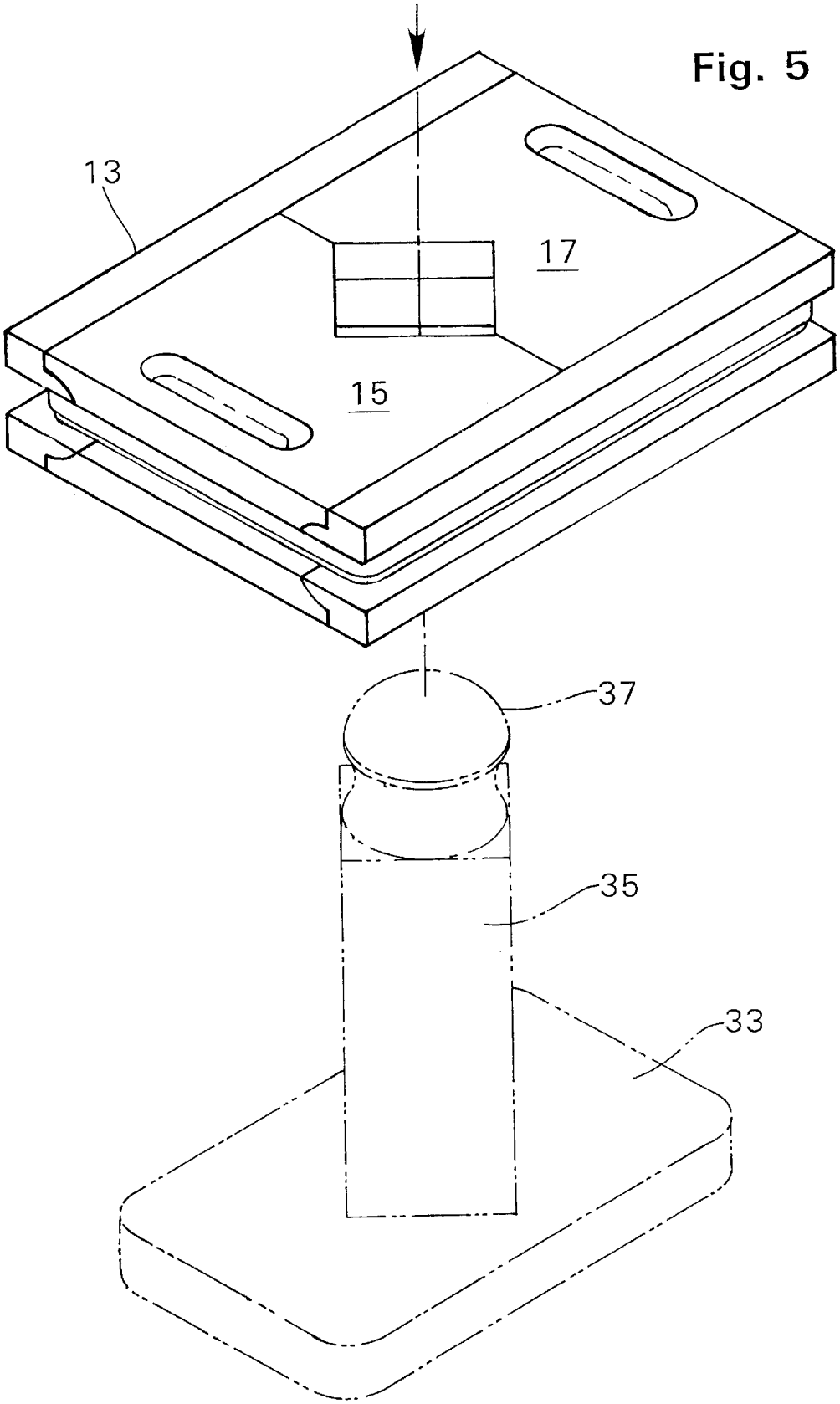
FIG. 5 is front top right isometric view of the present invention with a supporting stand as an additional element of the present invention.

Referring now to FIG. 5, a stand for holding a plurality of holders of the present invention is depicted. The stand includes a planar base 33 with a central support tower 35 extending vertically from the base. The shape of the tower is preferably rectangular and dimensioned to be slightly larger than the opening between the holder jaws 15 and 17 at rest. Holders 13 placed on the stand are therefore stored in gripping relation to the tower 35. This ensures that all holders are retained firmly in place. The jaws of each holder are retracted as it is removed from the stand.

FIGS. 6, 6*a* and 6*b* show an alternate embodiment of the present invention which can economically be produced by molding identical parts produced from a settable material, such as plastic. Referring now to FIG. 6, a first jaw 61 includes a side rail portion 63 which is unitary therewith. Similarly, a second opposing jaw 65 includes side rail 67 which is unitary therewith. The two components are interfitted by means of interlocking ways 60 and 62, on the inside surfaces of the side rail portions which interlock with ways 64 and 66 respectively on the outside edges of the main body portion 61 or 63 on the opposing jaw. The bottle cap-gripping function is similar to the embodiment shown in FIGS. 1–5 with resilient holding provided by band 69. The embodiment shown in FIG. 6 similarly includes handgrip indentations 68.

Referring now to FIGS. 6*a* and 6*b*, greater detail of the slidable interlocking ways is shown. In this embodiment, the interlock is provided by the dovetail-type sliding joint, although it should be understood that other types of interlocking joints may be used. As shown in FIG. 6*a*, jaw 65 includes a dovetail recess 71 which corresponds to a projection 73 on the side rail 63. Referring now to 6*b*, the opposite side of the holder includes similar, slidable mating structures 75 and 77 found on the opposite side of opposing jaw 65. Thus, by employing the structure depicted in FIG. 6, two identical mating parts with the addition of an elastic band can constitute the entire invention. This provides a great advantage in economy of production.

The present invention offers many advantages over the prior art. For example, its construction is extremely simple as it includes only two moving parts. The use of an elastic band as a resilient member also reduces the cost of manufacture and makes the elastic band easily replaceable or, in turn, may be easily supplemented with an elastic band of greater resilience or additional bands if additional grip on the bottle cap is required. The present invention is shown with V-shaped notches on each of the holder jaws, however, it should be understood that jaws of different configuration may be used as desired.

It should be understood that the above description discloses specific embodiments of the present invention and are for purposes of illustration only. There may be other modifications and changes obvious to those of ordinary skill in the art that fall within the scope of the present invention which should be limited only by the following claims and their legal equivalents.

What is claimed is:

1. A bottle holder, comprising:

a substantially planar base, including a fixed jaw and parallel side rails;

a movable jaw slidably engaged with said side rails such that said movable jaw is guided between positions toward and away from said fixed jaw in a plane of motion occupied by said fixed jaw; and, resilient means affixed between said base and said movable jaw to bias said jaws toward a closed position.

2. The bottle holder of claim 1, wherein said jaws each include a V-shaped clamping groove.

3. The bottle holder of claim 2, wherein said resilient means is an elastic band.

4. The bottle holder of claim 3, wherein said elastic band is retained in a peripheral groove around the sides of said base and said movable jaw.

5. The bottle holder of claim 4, wherein said side rails have tongue-and-groove engagement with the lateral sides of said movable jaw.

6. The bottle holder of claim 5, further including a stand comprising a planar platform with a vertically-projecting tower, said tower affixed centrally on said platform, said bottle holder being in gripping engagement with said tower being held firmly between said jaws.

7. A bottle holder, comprising two identical, slidably engaged parts interlocked directly with each other, each part comprising a jaw portion and a side rail therewith;

each jaw portion including an integral slidable way interlockingly engagable with an integral way on the side rail portion of the other part such that when said parts are fitted together opposite one another, both jaws are held in opposing alignment with each other and are slidable between open and closed positions without other supporting structures; and an elastic band encircling side edges of said parts.

8. The bottle holder of claim 7, wherein said interlocking ways comprise interfitting male and female structures on said side rails and said jaw side edges respectively.

9. The bottle holder of claim 8, wherein said identical parts are composed of a settable material.

* * * * *